US010893791B2

(12) United States Patent
Rappette et al.

(10) Patent No.: US 10,893,791 B2
(45) Date of Patent: Jan. 19, 2021

(54) DISHWASHER AND SUMP ASSEMBLY

(71) Applicant: WHIRLPOOL CORPORATION, Benton Harbor, MI (US)

(72) Inventors: Antony Mark Rappette, Benton Harbor, MI (US); John Alan Miller, Stevensville, MI (US); Todd Michael Jozwiak, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 149 days.

(21) Appl. No.: 16/039,935

(22) Filed: Jul. 19, 2018

(65) Prior Publication Data

US 2020/0022557 A1 Jan. 23, 2020

(51) Int. Cl.
*A47L 15/42* (2006.01)
*A47L 15/23* (2006.01)

(52) U.S. Cl.
CPC ..... *A47L 15/4221* (2013.01); *A47L 15/23* (2013.01); *A47L 15/4206* (2013.01); *A47L 15/4208* (2013.01); *A47L 15/4225* (2013.01)

(58) Field of Classification Search
CPC ... A47L 15/4202–4208; A47L 15/0078; A47L 15/42; A47L 15/4219; A47L 15/4223; A47L 15/4225; A47L 15/00–508
See application file for complete search history.

(56) References Cited

U.S. PATENT DOCUMENTS

| | | | | |
|---|---|---|---|---|
| 4,741,353 | A | 5/1988 | Milocco | |
| 7,431,774 | B2 | 10/2008 | Kim | |
| 8,714,167 | B2 | 5/2014 | Yoon et al. | |
| 9,816,221 | B2 | 11/2017 | Harwood et al. | |
| 2004/0163690 | A1* | 8/2004 | Kim | A47L 15/4206 134/104.1 |
| 2006/0237035 | A1 | 10/2006 | Ferguson et al. | |
| 2016/0143504 | A1* | 5/2016 | Welch | A47L 15/4223 415/182.1 |
| 2018/0192847 | A1* | 7/2018 | Kim | A47L 15/4206 |
| 2019/0099055 | A1* | 4/2019 | Feddema | A47L 15/4225 |

FOREIGN PATENT DOCUMENTS

| | | | |
|---|---|---|---|
| CN | 202113035 | U | 1/2012 |
| CN | 202446037 | U | 9/2012 |
| CN | 203935158 | U | 11/2014 |
| CN | 104688157 | A | 6/2015 |
| CN | 204562055 | U | 8/2015 |
| EP | 2263512 | B1 | 6/2015 |
| GB | 2240708 | B | 8/1991 |
| KR | 20170011113 | A | 2/2017 |

* cited by examiner

*Primary Examiner* — Michael E Barr
*Assistant Examiner* — Omair Chaudhri
(74) *Attorney, Agent, or Firm* — McGarry Bair PC

(57) ABSTRACT

A dishwasher includes a tub at least partially defining a treating chamber with an access opening, a sump fluidly coupled to the treating chamber, at least one sprayer emitting liquid into the treating chamber, a pump, a conduit fluidly coupling the sump to the pump and the pump to the at least one sprayer, thereby defining a recirculation circuit through which the liquid sprayed into the treating chamber collects in the sump and is pumped back to the at least one sprayer, a filter assembly provided in the sump and having a filter through which at least a portion of the liquid passes, and an insert sleeve at least partially located within the filter assembly.

6 Claims, 8 Drawing Sheets

DISHWASHER AND SUMP ASSEMBLY

BACKGROUND

Contemporary automatic dishwashers for use in a typical household include a tub defining a treating chamber and a spraying system for recirculating liquid throughout the tub to remove soils from dishes and utensils. The tub includes a sump at its lowest point that collects the liquid supplied to the treating chamber for washing dishes. A sump unit including a pump assembly can be provided for recirculating and draining liquid from the sump. The pump assembly must be below the sump so that wash liquid in the sump can be gravity-fed into the pump assembly. The liquid can drain into the sump and recirculate back to the tub via a recirculation circuit. The recirculation circuit can include a filter assembly in order to filter particulates from the liquid before it enters the tub. A dirty, or clogged filter assembly can cause the filter assembly to not efficiently filter the liquid.

BRIEF DESCRIPTION

In one aspect, the present disclosure relates to a dishwasher including a tub at least partially defining a treating chamber with an access opening, a sump fluidly coupled to the treating chamber and defining a portion of the treating chamber, at least one sprayer emitting liquid into the treating chamber, a pump, a conduit fluidly coupling the sump to the pump and the pump to the at least one sprayer, thereby defining a recirculation circuit through which the liquid sprayed into the treating chamber collects in the sump and is pumped back to the at least one sprayer, a filter assembly provided in the sump and including a filter through which at least a portion of the liquid passes, and an insert sleeve at least partially located within the filter assembly and wherein a portion of the insert sleeve forms a displacement body within the filter to raise the level of liquid within the sump.

DETAILED DESCRIPTION

While this description will reference many different features for a dishwasher, one beneficial and advantageous feature is a filter assembly that includes a nozzle for spraying liquid into a filter cup. The nozzle improves filter assembly function by using a stream of water to break up large food particles to allow for continual flow of fluid though the filter.

Another advantageous feature is a sump assembly that includes a drain volute having a regulated vent for priming the drain pump. The regulated vent allows the drain pump to operate more effectively. Yet another advantageous feature is an insert sleeve for a filter assembly that forms a displacement body to raise the level of liquid in the sump. Many dishwashers are run with low water amounts in order to save water and reduce energy levels. Thus, the displacement body can provide more efficient filtering of fluid by creating a higher water level in the filter assembly in order for fluid to flow into the filter.

Figure 1:
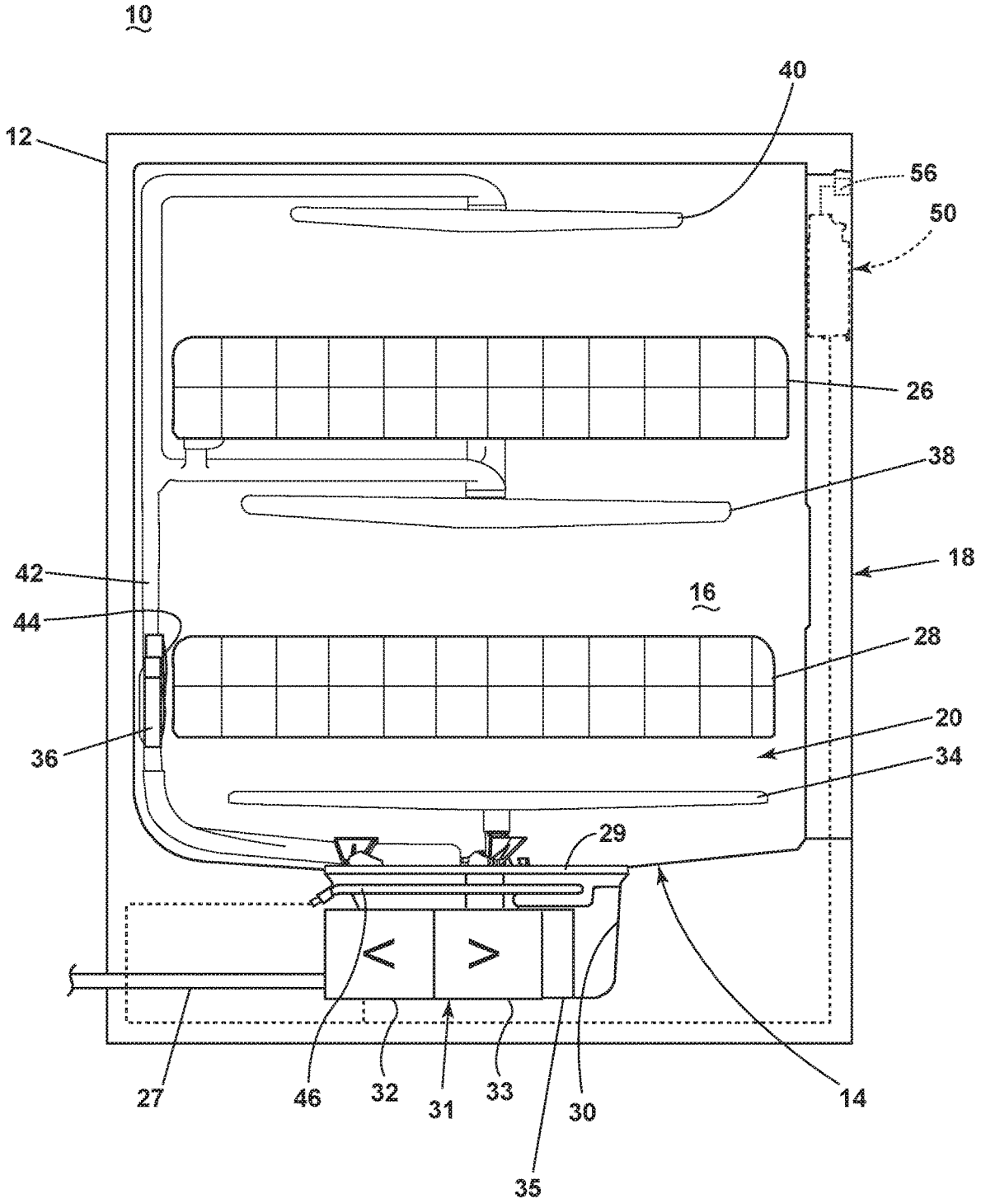
FIG. 1 is a schematic, cross-sectional view of a dishwasher according to an aspect of the present disclosure.

In FIG. 1, an automated dishwasher 10 according to aspects of the present disclosure is illustrated. The dishwasher 10 shares many features of a conventional automated dishwasher, which will not be described in detail herein except as necessary for a complete understanding. A chassis 12 can define an interior of the dishwasher 10, including a space below the tub 14 and can include a frame, with or without panels mounted to the frame. An open-faced tub 14 can be provided within the chassis 12 and can at least partially define a treating chamber 16, having an open face, for washing dishes. A door assembly 18 can be movably mounted to the dishwasher 10 for movement between opened and closed positions to selectively open and close the open face of the tub 14. Thus, the door assembly 18 provides accessibility via an access opening 20 to the treating chamber 16 for the loading and unloading of dishes or other washable items.

It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open.

A dish rack assembly, illustrated in the form of upper and lower dish racks 26, 28, is located within the treating chamber 16 and receives dishes for washing. The upper and lower racks 26, 28 are typically mounted for slidable movement in and out of the treating chamber 16 for ease of loading and unloading. The upper and lower dish racks 26, 28 can be in the form of a wire frame rack. Other dish holders can be provided, such as a silverware basket. As used in this description, the term "dish(es)" is intended to be generic to any item, single or plural, that can be treated in the dishwasher 10, including, without limitation, dishes, plates, pots, bowls, pans, glassware, and silverware. While the dishwasher 10 is shown with two dish racks, any number of dish racks can be included.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety. The spray assemblies 34, 36, 38, 40 can be rotated by way of a motor or hydraulics.

While not shown, a liquid supply system can include a water supply conduit coupled with a household water supply for supplying water to the treating chamber 16.

A recirculation circuit, or recirculation system is provided for recirculating liquid from the treating chamber 16 to the spray system. The recirculation system can include a sump 30 and a pump assembly 31. The sump 30 collects the liquid sprayed in the treating chamber 16 and can be formed by a sloped or recess portion of a bottom wall of the tub 14. Further still, a coarse screen filter 29 may be provided at a bottom wall of the tub 14 to prevent large objects or soils from entering the sump 30. The pump assembly 31 can include both a drain pump 32 and a recirculation pump 33. The drain pump 32 can draw liquid from the sump 30 and pump the liquid out of the dishwasher 10 to a household drain line 27. The recirculation pump 33 can draw liquid from the sump 30 and the liquid can be simultaneously or selectively pumped through a conduit, such as a supply tube 42 to each of the assemblies 34, 36, 38, 40 for selective spraying into the treating chamber 16.

A filter assembly 35 can be provided in the sump 30 and can filter the liquid in the recirculation system. The filter assembly 35 filters out soils and prevents the soils from recirculating during the cycle of operation. During draining, at least some of the soils filtered by the filter assembly 35 are removed with the drain water.

A heating system including a heater 46 can be located within the sump 30 for heating the liquid contained in the sump 30.

A controller 50 can also be included in the dishwasher 10, which can be operably coupled with various components of the dishwasher 10 to implement a cycle of operation. The controller 50 can be located within the door 18 as illustrated, or it can alternatively be located somewhere within the chassis 12. The controller 50 can also be operably coupled with a control panel or user interface 56 for receiving user-selected inputs and communicating information to the user. The user interface 56 can include operational controls such as dials, lights, switches, and displays enabling a user to input commands, such as a cycle of operation, to the controller 50 and receive information.

Figure 2:
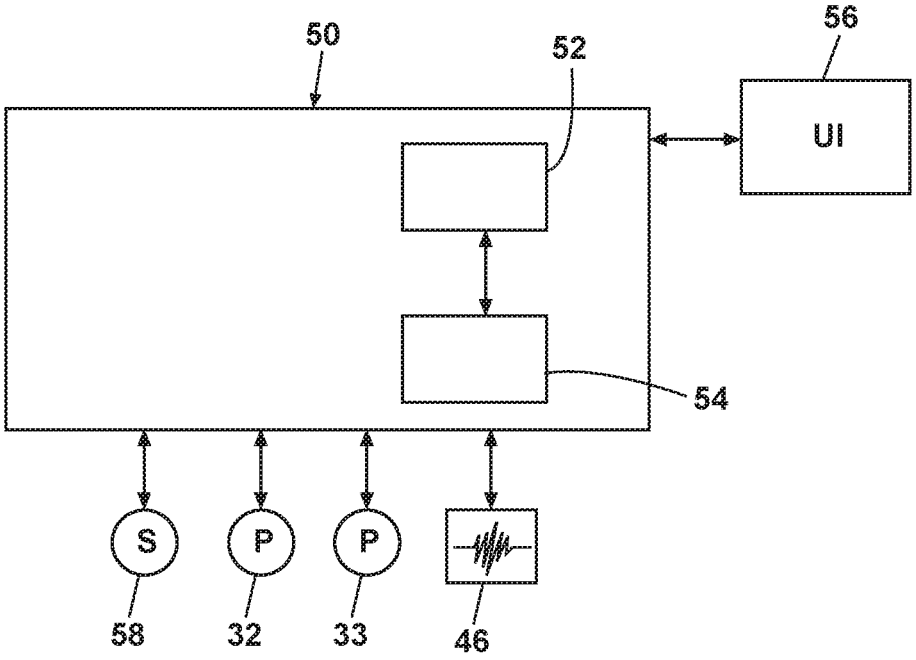
FIG. 2 is a schematic view of a controller of the dishwasher of FIG. 1.

As illustrated schematically in FIG. 2, the controller 50 can be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 can be provided with a memory 52 and a central processing unit (CPU) 54. The memory 52 can be used for storing control software that can be executed by the CPU 54 in completing a cycle of operation using the dishwasher 10 and any additional software. For example, the memory 52 can store one or more pre-programmed cycles of operation that can be selected by a user and completed by the dishwasher 10. The controller 50 can also receive input from one or more sensors 58. Non-limiting examples of sensors that can be communicably coupled with the controller 50 include a temperature sensor and turbidity sensor to determine the soil load associated with a selected grouping of dishes, such as the dishes associated with a particular area of the treating chamber.

Figure 3:
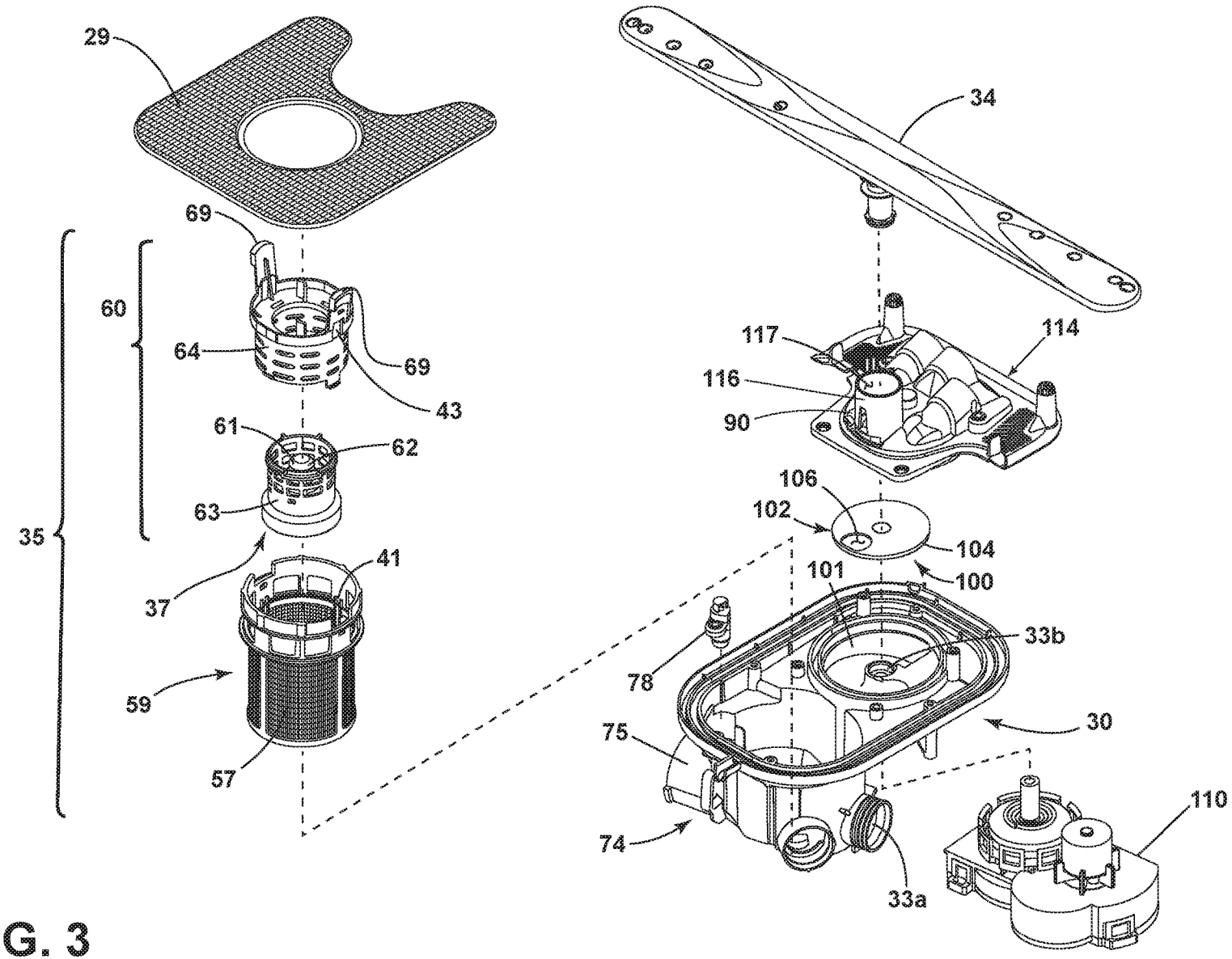
FIG. 3 is an exploded view of a sump and filter assembly according to various aspects described herein.

FIG. 3 is an exploded view illustrating the sump 30 and filter assembly 35 in greater detail. The filter assembly 35 includes a filter 59 through which at least a portion of liquid collected in the sump 30 passes to filter liquid in the liquid flow path to the spray assemblies 34, 36, 38, and 40. The filter 59 can include a microfilter screen 57 suitable for filtering particles approximately 300 μm or larger, as opposed to the coarse screen filter 29, which filters larger particles.

An insert sleeve 60, or filter cup, can be at least partially located within the filter assembly 35 and can include a first interior portion 63 and a second concentric portion 64. The first interior portion 63 and the second concentric portion 64 can be in an annular configuration. In one example, the second concentric portion 64 is in the form of a second filter wall. Ribs 41 on the filter 59 can be provided to locate the insert sleeve 60 within an upper portion of the filter 59. A recess 43 on an exterior of the second concentric portion 64 can slideably receive the ribs 41 such that the insert sleeve 60 can slide over the ribs 41 until an upper portion of the ribs 41 reaches a stop formed by an upper portion of the recess 43. At least a portion of the insert sleeve 60 forms a displacement body 62 within the filter 59. The displacement body 62 is configured to raise the level of liquid within the sump 30 and can be any suitable shape or structure. In one example, the displacement body 62 is an air dome structure 61. The air dome structure 61 can be a raised, hollowed out portion of the insert sleeve 60 that can displace 30 milliliters (mL) or more of liquid within the sump 30, which can result in improved pump stability.

An impeller of the recirculation pump 33 is fluidly coupled to a first outlet **33*a* of the sump 30 and the liquid may be simultaneously or selectively pumped through a supply conduit 33*b* to a diverter housing 101 leading to each of the spray assemblies 34, 36, 38, 40 for selective spraying into the treating chamber 16 via a liquid flow path. A diverter valve assembly 100 can be provided within the diverter housing 101 for selectively controlling the supply of liquid to one or more of the spray assemblies 34, 36, 38, 40 at a time. The recirculation pump 33 can be configured to draw liquid from the sump 30 and provide the liquid to the diverter housing 101 and the diverter valve assembly 100. The diverter valve assembly 100 can include a rotatable diverter valve element 102, which may be located within the diverter housing 101 and driven by a drive system 110. The diverter valve element 102 is rotated by the drive system 110 between multiple positions to selectively divert liquid flowing from the treating chamber 16 between the spray assemblies 34, 36, 38, and 40**.

The diverter valve element 102 is illustrated as a rotatable diverter disk 104 having at least one opening 106, which may align an interior of the diverter housing 101 with an opening or passageway in an outlet cover 114 to selectively fluidly couple fluid in the sump 30 to the various spray assemblies 34, 36, 38, and 40 when the diverter disk 104 is rotated to one of the multiple positions. For example, a lower spray attachment 116 can extend vertically from the supply conduit **33*b* in the outlet cover 114 and forms a passageway 117 to the first lower spray assembly 34. Thus, the lower spray attachment 116 may fluidly couple to the first lower spray assembly 34. The first lower spray assembly 34 may be rotatably mounted on the lower spray attachment 116. Such a diverter valve assembly 100** is set forth in detail in U.S. Pat. No. 10,004,378, issued Jun. 26, 2018, and titled "Dishwasher with Controlled Rotation of Lower Spray Arm," which is incorporated herein by reference in its entirety.

Figure 4:
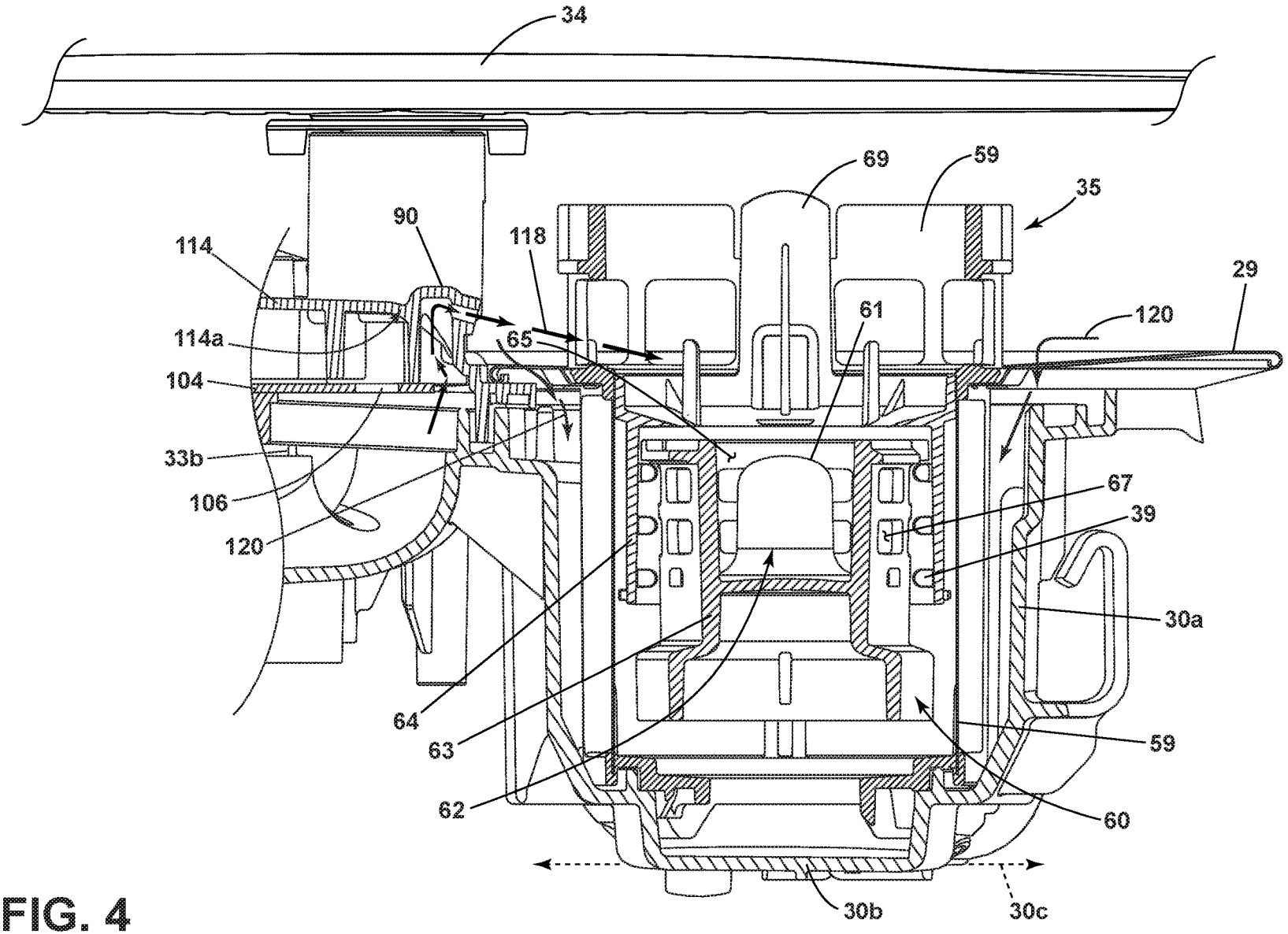
FIG. 4 is a cross-sectional side view of the filter assembly of FIG. 3.

FIG. 4 is a cross-sectional side view of the filter assembly of FIG. 3 assembled within the sump 30. The first filter interior portion 63 can be formed on the insert sleeve 60 and can be contiguous with the air dome structure 61 to define an interior 65. Foreign objects from the sump 30 can be trapped within the interior 65 of the insert sleeve 60 such that the foreign objects are prevented from entering other components of the dishwasher 10 such as the recirculation pump 33 or the drain pump 32 (FIG. 1). The second concentric portion 64 can be located exteriorly of the first filter interior portion 63. Apertures 67 can be formed on the first interior portion 63 such that smaller objects can flow in or out of the apertures 67. The apertures 67 can be coarser than apertures 39 on the second concentric portion 64. In one example, the apertures 67 can be approximately 6-8 millimeters (mm) wide and 6-8 mm high while the apertures 39 can be approximately 10-11 mm wide and 3-4 mm high.

While the second concentric portion 64, or second filter wall, is illustrated as extending only a portion of the length of the filter 59, it is within the scope of aspects described herein for the second concentric portion 64 to extend more or less of the length of the filter 59. For example, the second concentric portion 64 can extend the same length of the filter 59 as the first interior portion 63.

The sump 30 can further include a nozzle 90 provided adjacent the filter assembly 35. The nozzle 90 is configured to provide liquid, or water, into the filter cup 60. The nozzle 90 can be located on an edge 114*a* of the outlet cover 114. The liquid supplied to the nozzle 90 can be used to break up soils that collect on the filter 59 and to continuously supply liquid to the filter assembly 35. More specifically, a circumference of the diverter disk 104 is smaller than a circumference of the outlet cover 114 of the diverter valve assembly 100 such that liquid pumped into the diverter housing 101 always passes along a periphery of the diverter disk 104 into the nozzle 90.

In typical operation, liquid can enter the sump 30 via the coarse screen filter 29, as seen by flow lines 120. Such liquid can enter the sump 30 via a path that bypasses the filter 59. More specifically, during portions of the cycle of operation where there is a low water level it has been found that the liquid does not flow past the coarse screen filter 29 instead all of the liquid passes through the coarse screen filter 29 and enters the sump 30. This results in no, or very little liquid, traveling through the filter cup 60, which results in no filtering at the level of provided by the filter 59. This can be a detriment to the cycle of operation at low water levels.

However, with the inclusion of the nozzle 90 and because the circumference of the diverter disk 104 can be smaller than a circumference of the outlet cover 114, liquid can be continually supplied to the nozzle 90 from the supply conduit 33*b*, regardless of the orientation of the diverter disk 104. Further, liquid, as seen by flow lines 118, can be sprayed into the filter cup 60 during the entire recirculation of liquid regardless of return water levels.

Figure 5:
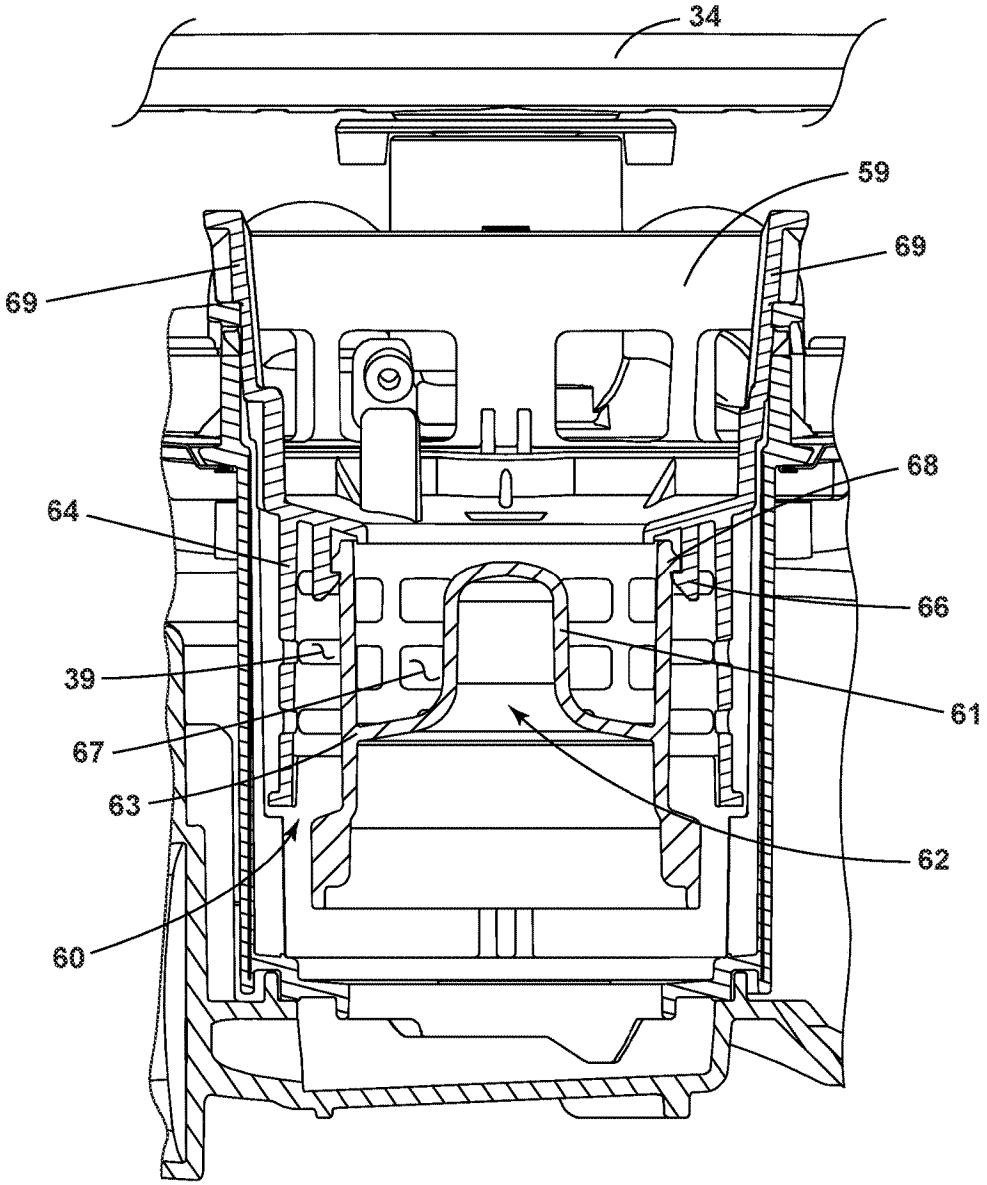
FIG. 5 is a second cross-sectional side view of the filter assembly of FIG. 3.

FIG. 5 is a cross-sectional side view of the filter assembly of FIG. 3. In the illustrated example, at least one detent 66 on the second concentric portion 64 can couple with at least one protrusion 68 on the first interior portion 63 to couple the two together. The detent 66 can be in the form of a recess extending inwardly from the second concentric portion 64. The protrusion 68 can be in the form of a rib extending inward from the first interior portion 63 that can be engaged within the detent 66. It is also possible for the second concentric portion 64 to include a protrusion, while the first interior portion 63 includes a detent.

In one example, one or more user-engageable tabs 69 are operably coupled to the detent 66 such that the tabs are moveable to disengage the detent 66 from the protrusion 68. For example, the detent 66 can be formed on the tabs 69. In another example, the tabs 69 can be operably coupled to the protrusion 68 to disengage the protrusion 68 from detent 66 in order to decouple the first interior portion 63 from the second concentric portion 64 of the insert sleeve 60. Alternatively, the insert sleeve 60 can be formed as a singular piece.

Figure 6:
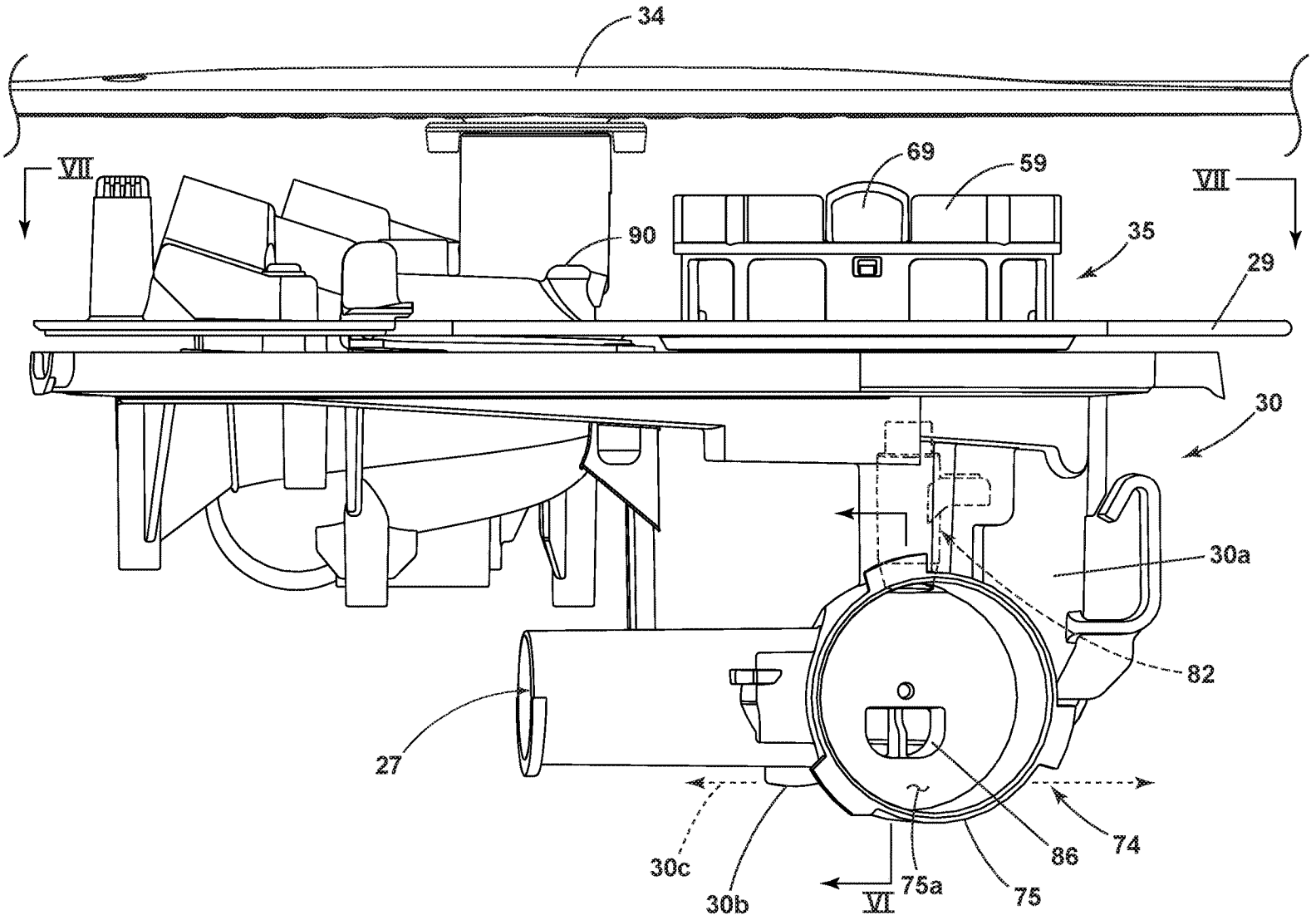
FIG. 6 is a side view of the filter assembly of FIG. 3.

FIG. 6 is side perspective view illustrating the sump 30 with the filter assembly 35, and portions of the recirculation circuit including the first lower spray assembly 34 in more detail. The sump 30 can be defined by a peripheral wall 30*a* extending upwards from a base 30*b*, which is best illustrated in FIG. 4. A protrusion 74 can extend from the peripheral wall 30*a* of the sump 30. The protrusion 74 can be in the form of an annular wall that can define a volute 75 having an interior 75*a*. The majority of the volute 75 can lie above a plane 30*c* defined by the base 30*b* of the sump 30. As is typical, the volute 75 can be located upstream the drain pump 32. The drain pump 32 can include an impeller to pump liquid, or fluid, from the sump 30, through the volute 75, and to a discharge outlet, such as the drain line 27.

A passageway 86 defined through the peripheral wall 30*a* can fluidly couple the sump 30 and the drain pump 32. For example, the passageway 86 can allow liquid to flow from the sump 30 to the interior 75*a* of the volute 75. Furthermore, a regulated vent 78 can be coupled to the interior 75*a* of the volute 75 via an opening 76.

Figure 7A:
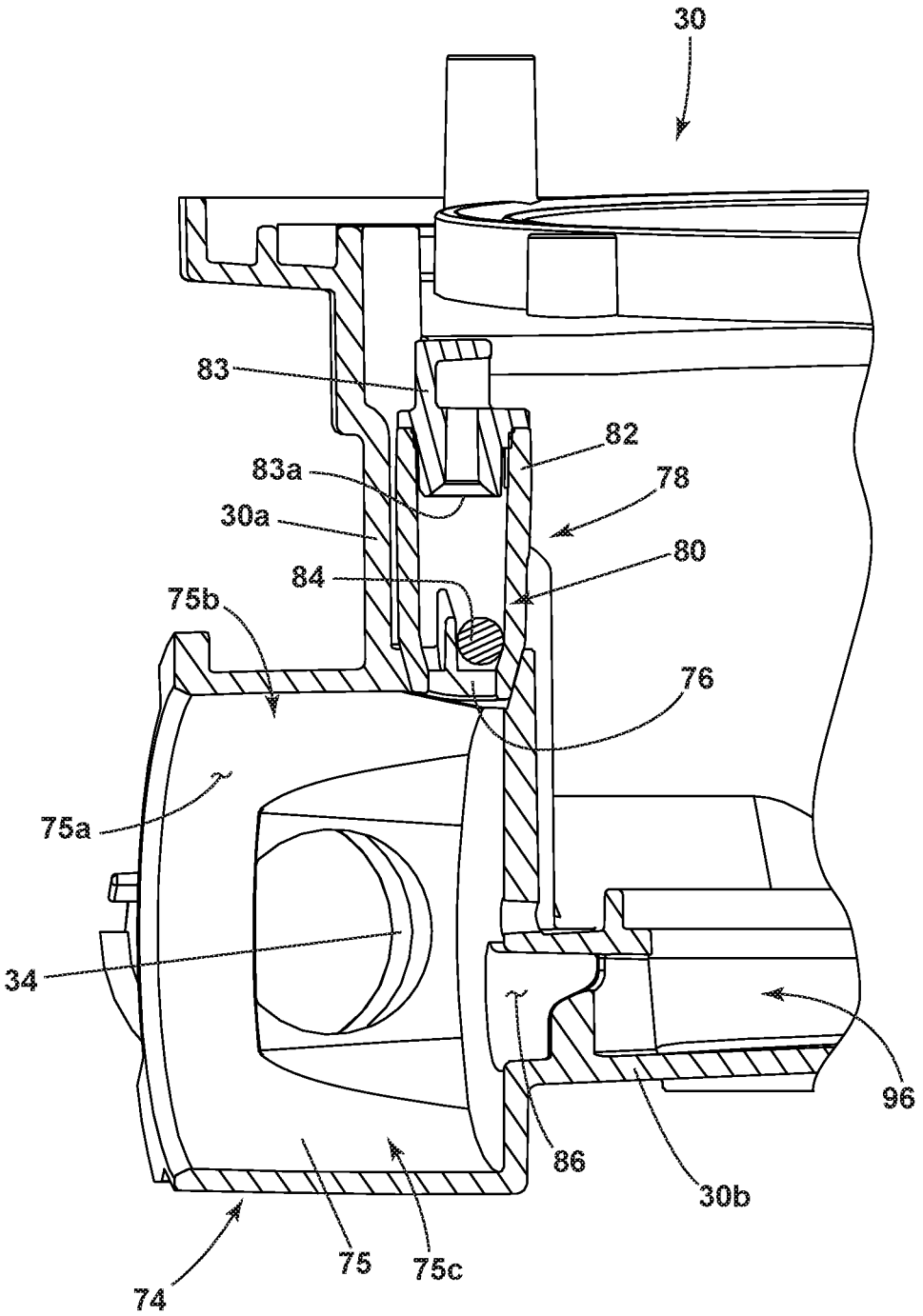
FIG. 7A is a cross-sectional view of the volute along line VII-VII of FIG. 6 in a not filled state according to various aspects described herein.

Turning to FIG. 7A, the volute 75 can include an upper portion 75*b* and a lower portion 75*c*. The opening 76 can be located at the upper portion 75*b* and can be fluidly coupled to the sump 30. The regulated vent 78 can be configured to permit air flow from the volute 75 and to block liquid flow from the volute 75, via the opening 76, in order to stop reintroduction of liquid to the sump 30. Stated another way, air can freely flow out of the opening 76 and the regulated vent 78 while liquid is prevented from freely flowing out of the opening 76 and the regulated vent 78. Air and liquid flow from the volute 75 can be regulated in any suitable manner, which can include a valve, which is described herein by way of non-limiting example as a vent tube assembly 80 in the form of a check-valve.

The vent tube assembly 80 can be provided within the sump 30 and can include a vent tube portion 82 and a cap 83. The vent tube portion 82 can be operably coupled to the opening 76 such that air can flow out of the opening 76 into the vent tube portion 82 and out of an opening 83*a* in the cap 83. A floating check ball 84 can be located within the vent tube assembly 80 and can rest upon the opening 76 when the volute 75 is not in a filled state, as illustrated in FIG. 7A.

Figure 7B:
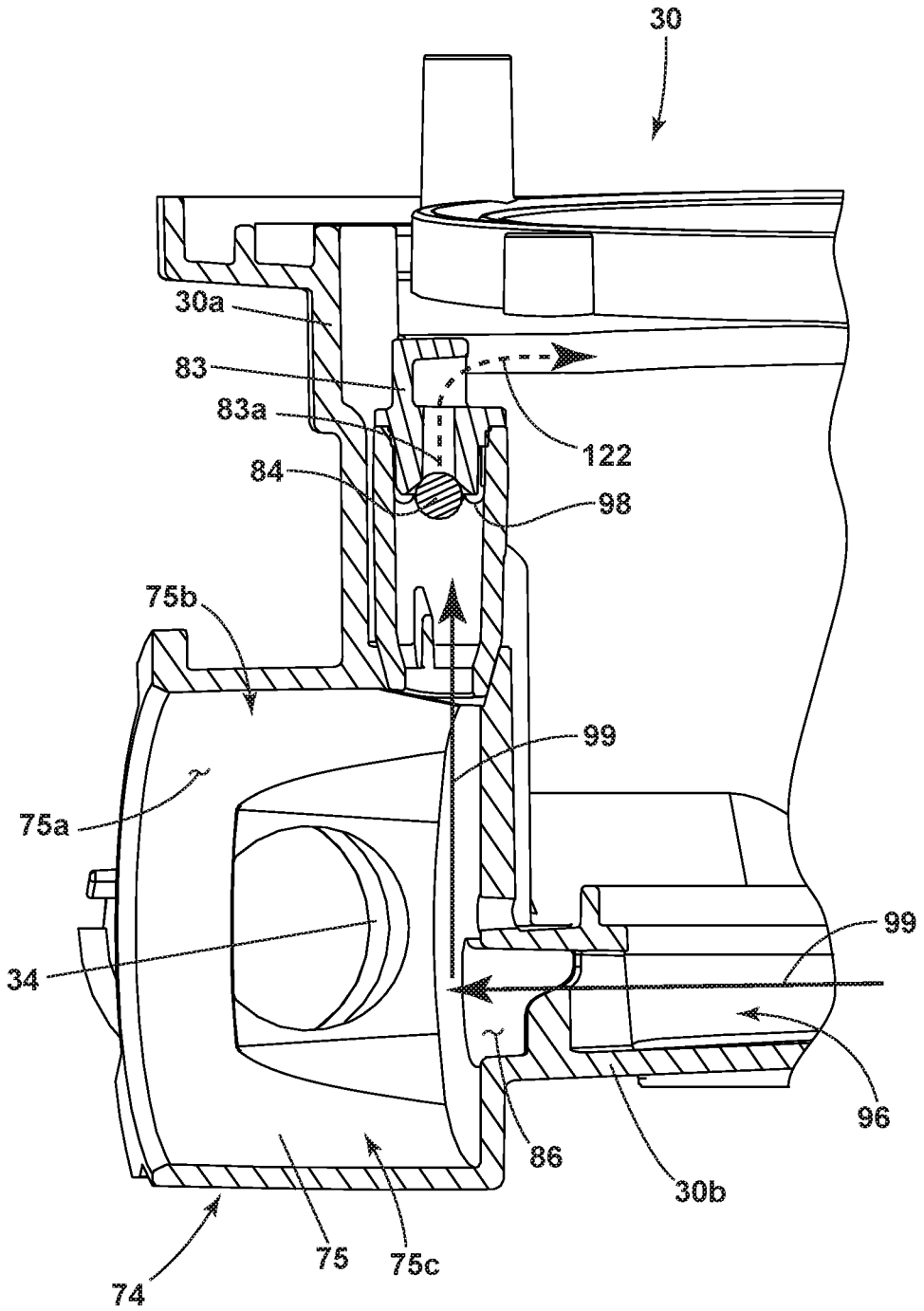
FIG. 7B is a cross-sectional view of the volute along line VII-VII of FIG. 6 in a filled state according to various aspects described herein.

In a filled state, as illustrated by FIG. 7B, the check ball 84 can be retained by the cap 83. The opening 83*a* in the cap 83 is smaller than the check ball 84 such that the check ball 84 cannot pass through the opening 83*a*. The opening 83*a* can be fluidly coupled to the sump 30 to allow air to escape from the volute 75 into the sump 30.

In operation, when liquid 99 enters the volute 75 from a drain path 96, air 122 from the volute 75 can flow from the opening 76 and into the vent tube portion 82 where the air 122 can escape from the opening 83*a* in the cap 83. When all of the air 122 within the volute 75 has exited the opening 76, and the volute 75 is partially filled with the liquid 99, the liquid 99 can rise into the vent tube portion 82 via the opening 76 and the check ball 84 can float upwards until a liquid level 98 rises high enough for the check ball 84 to seal the opening 83*a* in the cap 83. As a result, the drain pump 32 is primed for pumping and liquid 99 from within the volute 75 cannot escape into the sump 30.

The aspects of the disclosure described herein can be used to ensure that the sump, recirculation circuit, and drain pump operates efficiently. Aspects of the disclosure can be used to allow trapped air to escape from a drain pump volute so that the drain pump is primed and can operate efficiently. Aspects described herein can function to raise the level of water in the sump to allow for a lower water fill amount while maintaining recirculation pump stability. Low water amounts are advantageous in order to save water and reduce energy levels. Furthermore, aspects described herein can break up or clean out soils collected on a filter cup during a wash cycle to ensure that the filter assembly can effectively filter the liquid during a wash cycle.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

The invention claimed is:

1. A dishwasher comprising:

a tub at least partially defining a treating chamber with an access opening;

a sump fluidly coupled to the treating chamber and defining a portion of the treating chamber;

at least one sprayer emitting liquid into the treating chamber;

a pump;

a conduit fluidly coupling the sump to the pump and the pump to the at least one sprayer, thereby defining a recirculation circuit through which the liquid sprayed into the treating chamber collects in the sump and is pumped back to the at least one sprayer;

a filter assembly provided in the sump and comprising a filter through which at least a portion of the liquid passes;

an insert sleeve that is at least partially located within the filter assembly and defines an interior; and a displacement body comprising an air dome structure formed by a raised, hollowed out portion of the insert sleeve, wherein the air dome structure is contiguous with the insert sleeve to define the interior within the filter to raise a level of liquid within the sump.

2. The dishwasher of claim 1 wherein the air dome structure has a volume sufficient to displace 30 mL or more of liquid within the sump.

3. The dishwasher of claim 1 wherein the insert sleeve further includes a second filter wall formed therein.

4. The dishwasher of claim 3 wherein the insert sleeve includes a first interior portion including the air dome structure and a second concentric portion including the second filter wall and wherein the first interior portion includes one of a detent or a protrusion and the second concentric portion includes an other of the detent or the protrusion and wherein the detent and the protrusion are configured to engage with and couple to one another to retain the first interior portion within the second concentric portion and prevent decoupling of the first interior portion from the second concentric portion.

5. The dishwasher of claim 4, further comprising a user-engageable tab operably coupled to the other of the detent or the protrusion and moveable to disengage the other of the detent or the protrusion from the first interior portion to permit decoupling of the first interior portion from the second concentric portion.

6. The dishwasher of claim 1, further comprising a drain pump having an impeller to pump fluid from the sump to a discharge outlet, an annular wall extending from a peripheral wall of the sump and defining a volute for the drain pump, an opening defined in the annular wall and located at an upper portion of the volute, and a regulated vent fluidly coupled to the volute via the opening and configured to permit air flow from the volute and to block liquid flow from the volute.

* * * * *